US007419212B2

(12) United States Patent
Haygood et al.

(10) Patent No.: US 7,419,212 B2
(45) Date of Patent: Sep. 2, 2008

(54) PROTECTIVE STRIPS FOR USE IN THE MANUFACTURE OF UPHOLSTERED FURNITURE

(76) Inventors: David L. Haygood, 404 N. Columbia Ave., Shelfield, AL (US) 35660; Gary T. Schwertner, 404 N. Columbia, Shelfield, AL (US) 35660

( * ) Notice: Subject to any disclaimer, the term of this patent is extended or adjusted under 35 U.S.C. 154(b) by 293 days.

(21) Appl. No.: 11/259,067

(22) Filed: Oct. 27, 2005

(65) Prior Publication Data

US 2007/0096520 A1 May 3, 2007

(51) Int. Cl.
*A47C 31/00* (2006.01)

(52) U.S. Cl. ..... 297/218.5; 297/463.1

(58) Field of Classification Search ..... 297/463.1, 297/218.3, 218.5

See application file for complete search history.

(56) References Cited

U.S. PATENT DOCUMENTS 2,266,466 A * 12/1941 Linder ..... 160/378
2,673,600 A * 3/1954 Cramer ..... 297/452.59
3,040,343 A * 6/1962 Neely ..... 5/403
3,099,058 A * 7/1963 Pettingell ..... 24/707.8
3,281,185 A * 10/1966 Albinson et al. ..... 297/452.14
6,537,646 B2 * 3/2003 Haygood et al. ..... 428/132

FOREIGN PATENT DOCUMENTS

DE 3732836 C2 * 12/1988

* cited by examiner

*Primary Examiner*—Joseph F Edell
(74) *Attorney, Agent, or Firm*—Nixon & Vanderhye P.C.

(57) ABSTRACT

Protective strips for use in the manufacture of upholstered furniture include a fastening strip portion, a cover strip portion and a hinge portion which flexibly connects the fastening and cover strip portions to one another. In use, the protective strips may be positioned such that a portion of the upholstery fabric is sandwiched between the fastening strip portion thereof and a portion of the furniture frame to which the fabric is to be attached. Suitable fasteners (e.g., staples, tacks, nails, brads and like fasteners) may then be physically driven through the fastening strip portion and the underlying fabric portion into the furniture frame and thereby fasten the fabric portion physically to the frame. Once the fastening strip portion has been fastened to the furniture frame, the remaining fabric portion may be doubled over the fastened tail portion which in turn causes the cover strip portion to be folded over the fastening strip portion. In such a manner, the heads of the fasteners are physically covered by the cover strip portion so as to prevent contact with the overlaid fabric. As such, rubbing of the fabric against the fastener heads is prevented so as to thereby preclude (or at least substantially minimize) fabric abrasion and wear.

11 Claims, 7 Drawing Sheets

PROTECTIVE STRIPS FOR USE IN THE MANUFACTURE OF UPHOLSTERED FURNITURE

FIELD OF THE INVENTION

The present invention relates generally to the field of upholstered furniture. More specifically, the present invention relates to protective strips that are employed to fasten upholstery fabrics to furniture frames.

BACKGROUND AND SUMMARY OF THE INVENTION

During the manufacture of upholstered furniture, it is conventional to employ tacks and staples to fasten upholstery fabric to the underlying furniture frame. Various tack strips are known for such purpose. For example, conventional tack strips include a ribbon of metal from which generally triangularly shaped nails or tacks are punched and bent at right angles. See, U.S. Pat. Nos. 6,647,610, 6,857,178 and 6,989,186 (the entire contents of each such patent and patent application being expressly incorporated hereinto by reference).

Sometimes tack and/or staple guns are employed so as to fasten upholstery fabric to the furniture frame by means of individual fasteners such as staples, tacks, brads and/or nails. In this regard, a tail portion of the fabric is typically first fastened to the furniture frame by means of the fasteners so that the remaining portion may be folded over, and thereby cover, the fastener heads. It can be appreciated however that over time pressure or rubbing of the covering fabric portion on the tack or staple head will result in fabric wear.

It has been conventional practice to place a paperboard strip against the fabric tail and then drive the individual fasteners through the paperboard strip and fabric tail to secure the fabric to the underlying furniture frame. Such conventional practice has however not been entirely satisfactory Specifically, the fastener heads are still placed in contact with the covering fabric section and thus cause localized fabric abrasion and wear to occur. The likelihood of fabric abrasion and wear is more acute even with such a conventional paperboard strip in those instances where the tack or staple does not fully penetrate into the wood frame of the furniture piece or bends due to improper and/or incomplete installation.

Therefore, it would especially be desirable if upholstery fabric wear due to underlying tack and staple heads could be eliminated if not significantly minimized. It is toward fulfilling such a need that the present invention is directed.

Broadly, the present invention is embodied in a protective strip for use in the manufacture of upholstered furniture comprised of a fastening strip portion, a cover strip portion and a hinge portion which flexibly connects the fastening and cover strip portions to one another. In use, therefore, the protective strip of the present invention may be positioned such that a portion of the upholstery fabric is sandwiched between the fastening strip portion thereof and a region of the furniture frame to which the fabric is to be attached. Suitable fasteners (e.g., staples, tacks, nails, brads and the like) may then be physically driven through the fastening strip portion and the underlying fabric portion into the furniture frame. In such a manner, the fabric portion is attached physically to the furniture frame.

Once the fastening strip portion has been attached to the furniture frame, the remaining fabric portion may be doubled over the fastened tail portion which in turn causes the cover strip portion to be folded over the fastening strip portion. The heads of the fasteners are therefore physically covered by the cover strip portion so as to prevent contact with the overlaid fabric. As such, rubbing of the fabric against the fastener heads is prevented so as to thereby preclude (or at least substantially minimize) fabric abrasion and wear.

These and other aspects and advantages will become more apparent after careful consideration is given to the following detailed description of the preferred exemplary embodiments thereof.

BRIEF DESCRIPTION OF THE ACCOMPANYING DRAWINGS

Reference will hereinafter be made to the accompanying drawings, wherein like reference numerals throughout the various figures. denote like structural elements, and wherein;

FIG. 1 is a rear perspective view of an exemplary upholstered furniture piece (e.g., a chair) in which the protective upholstery strip of the present invention is employed;

FIG. 2*a* is an interior perspective view of a protective strip in accordance with the present invention;

FIG. 2*b* is an enlarged cross-section of the protective strip shown in FIG. 2*a* as taken along line 2*b*-2*b* therein;

FIG. 2*c* is an enlarged cross-section of the protective strip similar to FIG. 2*b* but depicted in a "closed" condition;

DETAILED DESCRIPTION OF THE INVENTION

Figure 1:
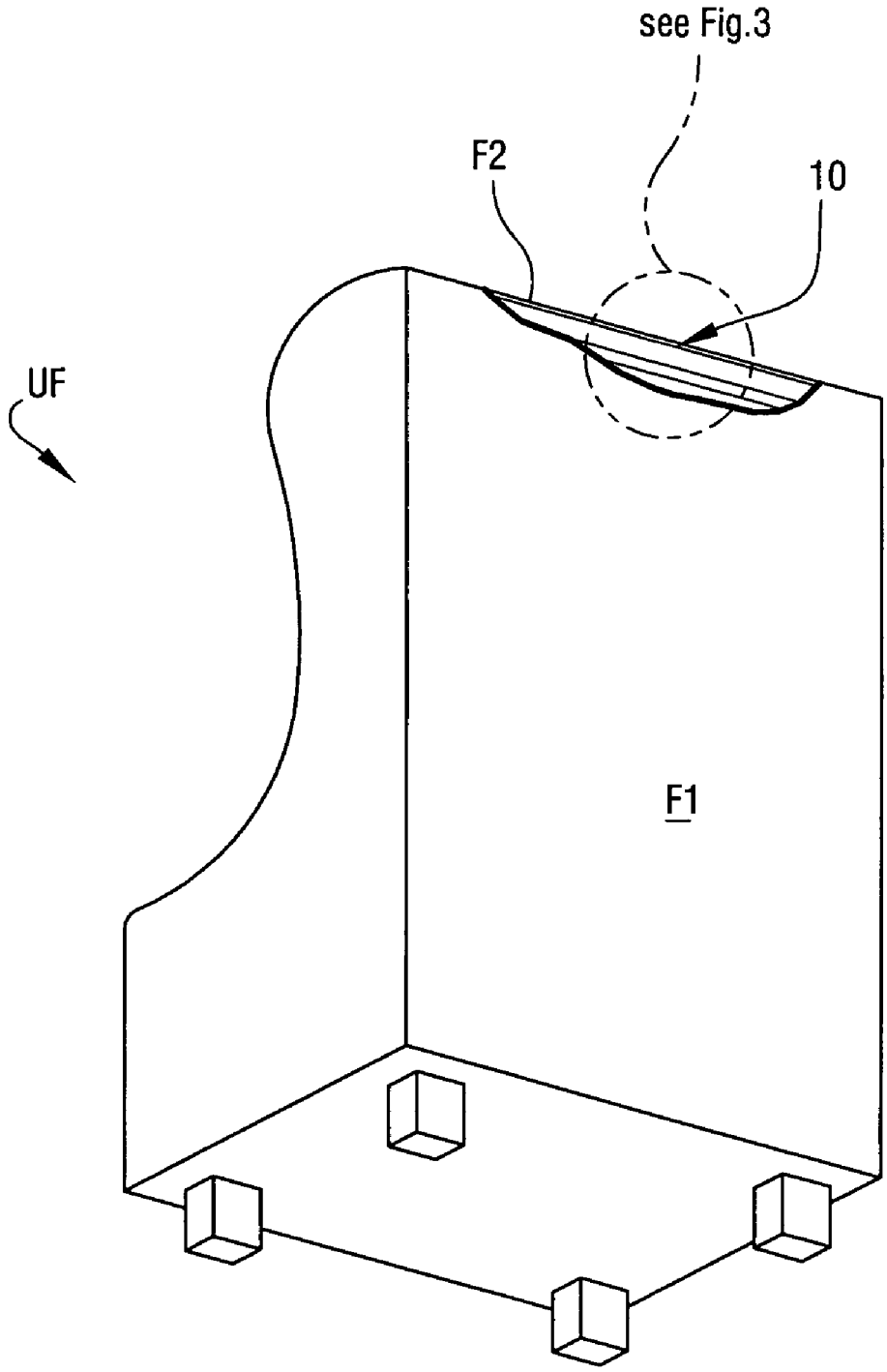

An exemplary upholstered furniture piece UF shown in FIG. 1 employs a protective strip 10 in accordance with the present invention. In this regard, the upholstered furniture piece UF shown in FIG. 1 just happens to be a chair. It is of course to be understood that the protective strip 10 of the present invention can be employed with virtually any type of upholstered furniture piece. Thus, although reference has been and may be made below to a chair, such a reference is for mere illustration and is not limiting to the present invention.

Staples will be referenced below as a presently preferred fastener to attach upholstery fabric to the furniture frame. The present invention is not limited to the use of staples as any other suitable fastener may be employed and is dependent upon the particular furniture manufacturers' preferences. Thus, as used herein and in the accompanying claims the term "fastener" means staples, tacks, brads, nails and the like that are employed to attach upholstery fabric to the furniture frame. Reference only to staples below is for the mere purpose of description simplicity.

Figure 2A:
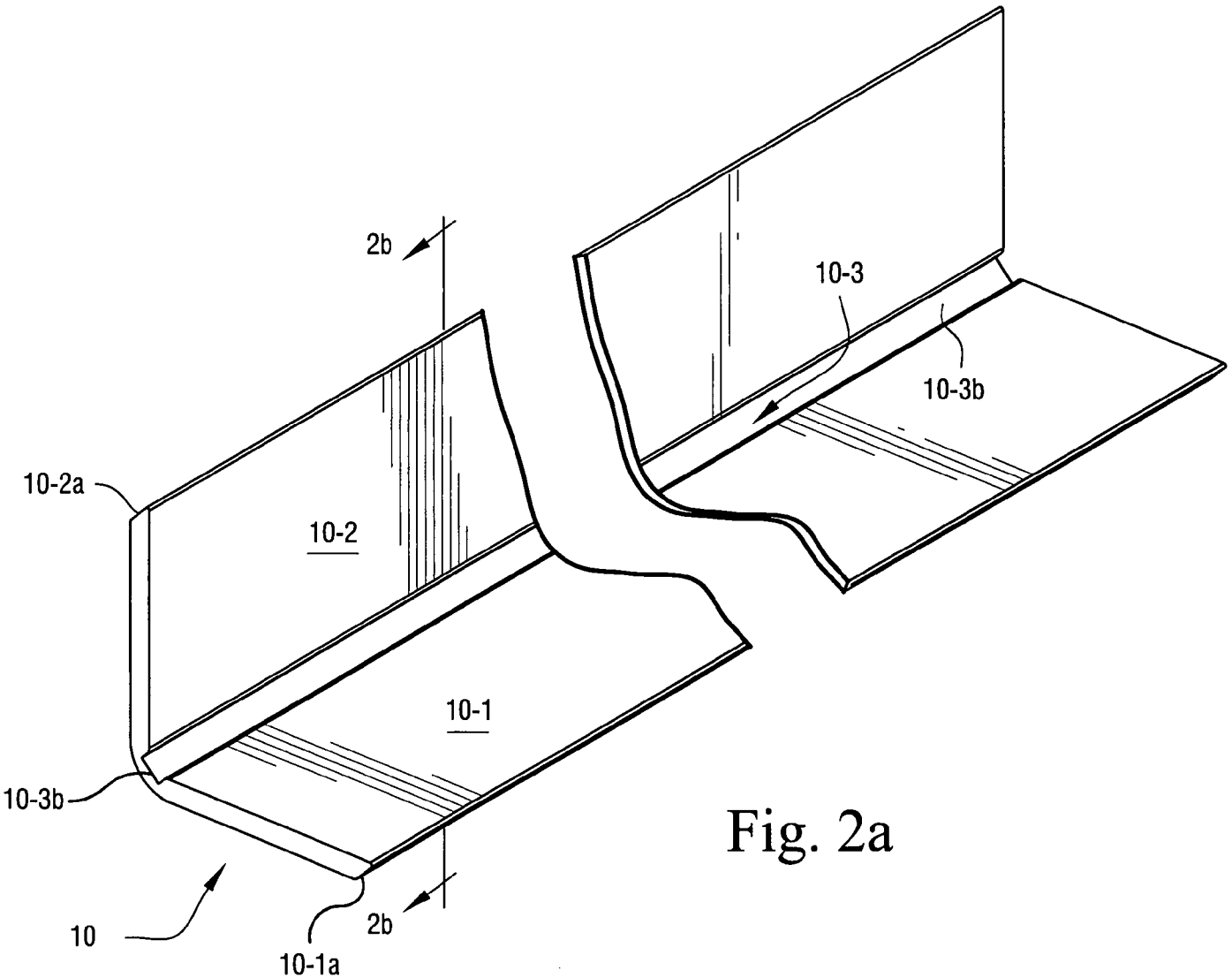
Figure 2B:
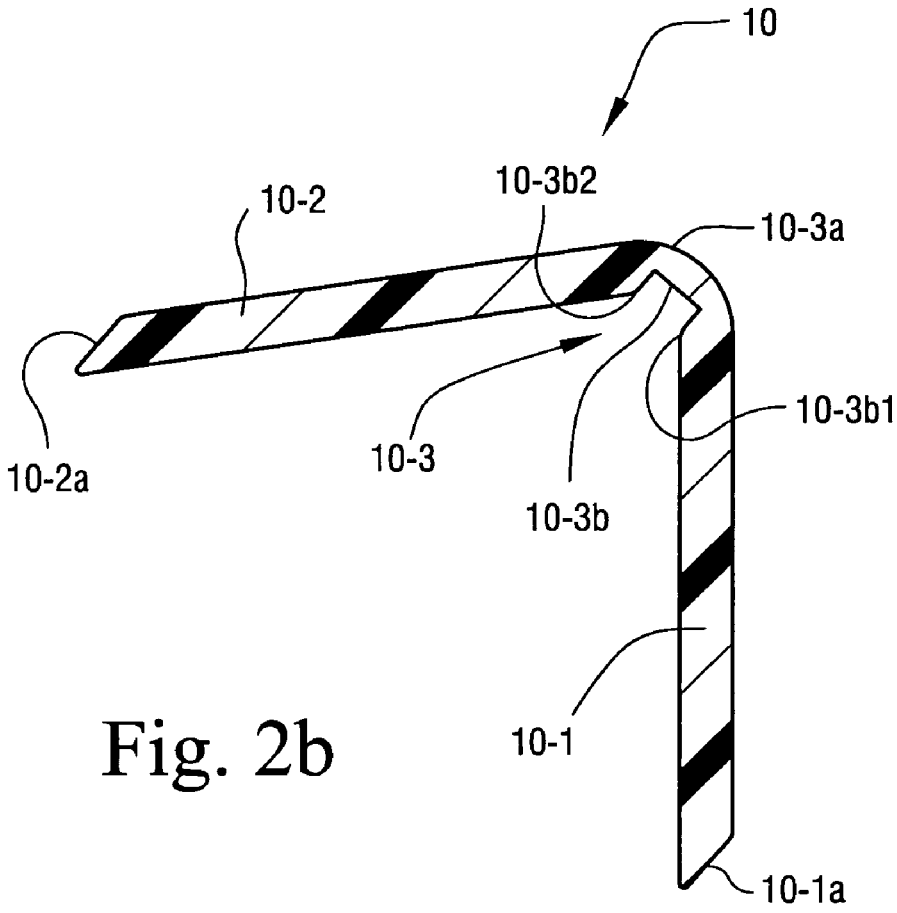
Figure 2C:
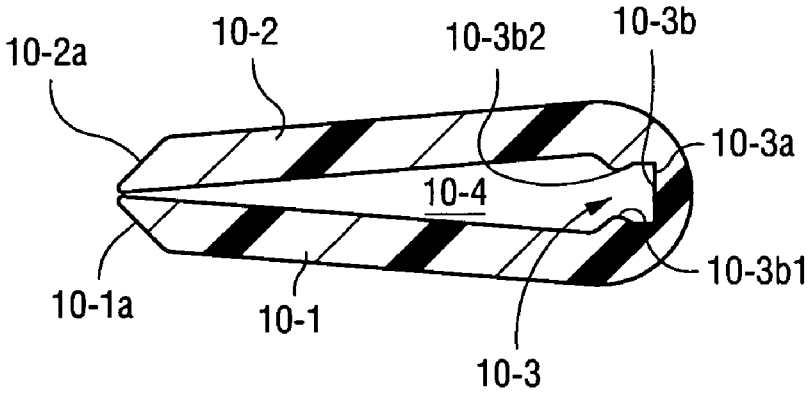

As can be seen from FIGS. 2*a*-2*c*, the protective strip 10 of this invention is most preferably formed of a thermoplastics material (for example, a polyolefin, such as polypropylene or polyethylene) as a one-piece (unitary) generally V-shaped structure. However, the present invention is not limited to the use of a thermoplastics material to form the protective strips 10. Instead, the protective strips 10 may be formed of virtually any material (for example, a paperboard material) that is capable of functioning in the manner described herein. Thus, reference below to a thermoplastics material is to be understood to be a presently preferred embodiment of this invention and is non-limiting to the same.

The protective strip 10 of this invention integrally includes a fastening strip portion 10-1, a cover strip portion 10-2 and a hinge portion 10-3 integrally and flexibly joining adjacent edges of the fastening and cover strip portions 10-1, 10-2, respectively, to one another. As is perhaps better seen in FIG. 2*b*, the hinge portion 10-3 includes a bridge 10-3*a* of reduced material thickness as compared to the thicknesses of the fastening and cover strip portions 10-1 and 10-2, respectively. More specifically, the hinge portion 10-3 is preferably formed by a generally planar inner surface 10-3*b* and a pair of oppositely disposed arcuately convex edge surfaces 10-3*b*1 and 10-3*b*2, respectively, which extend along the entire length of the protective strip 10. Thus, the hinge portion 10-3 is formed by means of an essentially recessed channel relative to the fastening and cover strip portions 10-1 and 10-2, respectively.

Each of the terminal edges 10-1*a* and 10-2*a* of the fastening and cover strip portions 10-1 and 10-2, respectively, is most preferably rounded so as to present a smooth surface to the overlying upholster fabric when affixed to the furniture frame.

As shown in FIG. 2*c*, the hinge portion 10-3 allows the fastening and cover strip portions 10-1 and 10-2, respectively, to be folded over onto one another into a "closed" condition so as to establish a generally interior V-shaped space 104. As can be seen, the interior space 10-4 establishes in cross-section a relatively narrow region adjacent the terminal ends 10-1*a* and 10-2*a*, and a relatively wider region adjacent the hinge region 10-3. The relatively wider region of the interior V-shaped space 10-4 thus serves to accommodate the heads of the fasteners that are driven through the fastening strip portion 10-1 and covered by the cover strip portion 10-2. In addition, the relatively wider region of the interior V-shaped space 10-4 accommodates misshapen fasteners that may occur when they are bent or deformed due to being improperly driven into the furniture frame through the fastening strip portion 10-1. When covered by the cover strip portion 10-2, therefore, a relatively smooth surface is presented to the fabric material.

The length of the protective strip 10 is not critical. Thus, the protective strip 10 can be provided to furniture manufacturers in an indefinite length (e.g., in roll form) or may be pre-cut to lengths that may be convenient. Preferably, however, it is currently envisioned that the protective strips 10 of this invention will most conveniently be supplied to furniture manufacturers as a roll of indefinite length (e.g., up to several thousand feet). The furniture manufacturer may then simply withdraw the protective strip 10 from the roll and cut it on site to desired custom lengths using conventional scissors or shears to suit the particular furniture being made.

Figure 3:
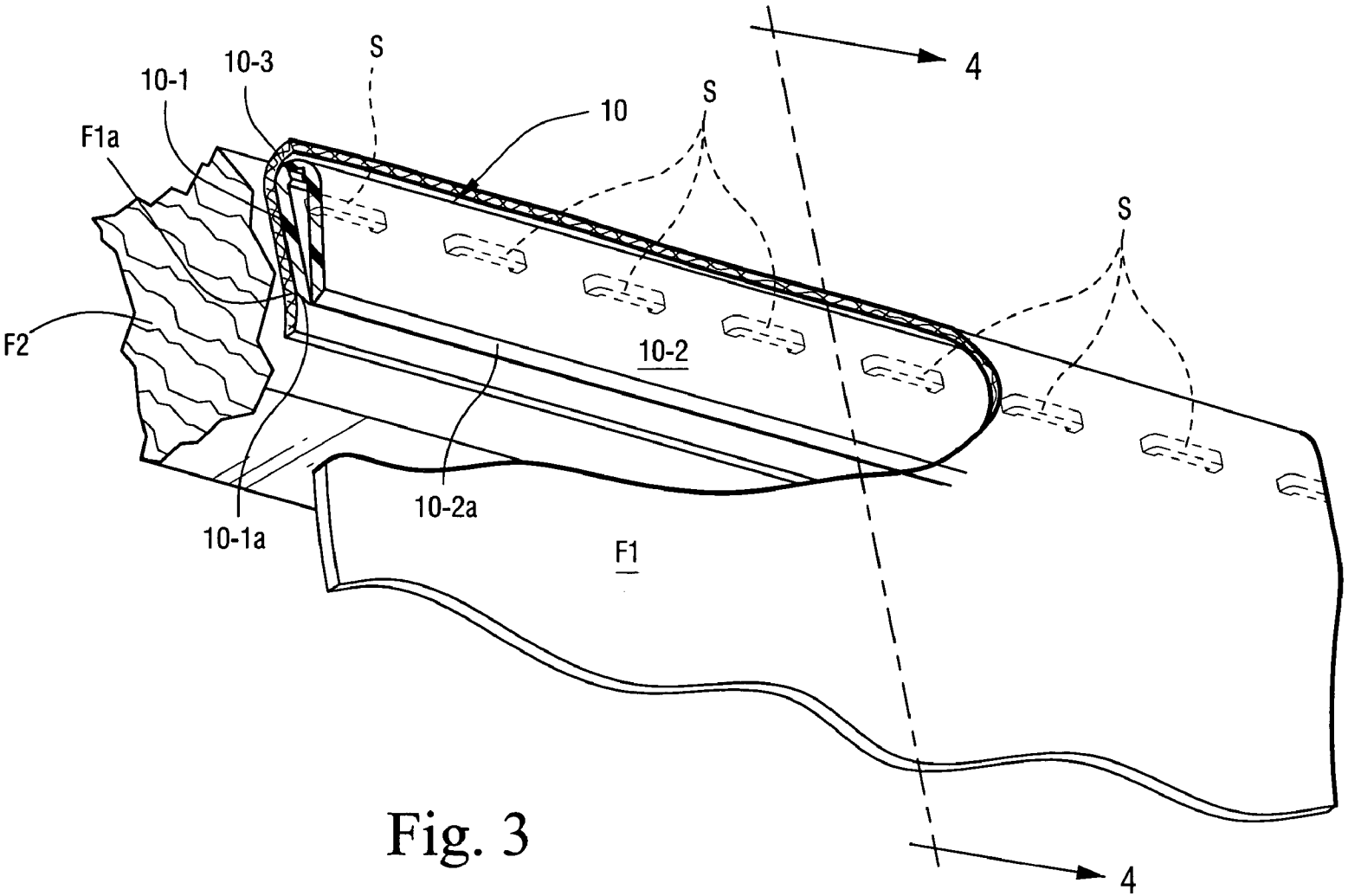
FIG. 3 is an enlarged perspective view of the region encircled by dashed line in FIG. 1.
Figure 4:
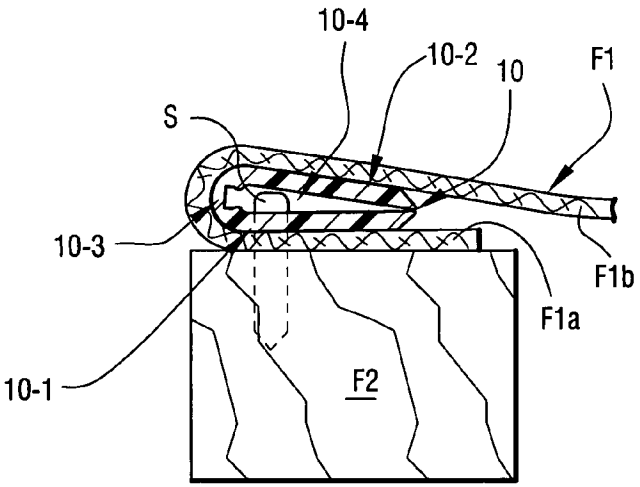
FIG. 4 is a cross-sectional elevational view of the upholstered furniture region as taken along line 4-4 in FIG. 3.

As shown in FIGS. 3 and 4, the protective strips 10 of this invention are employed to fasten the upholstery fabric F1 to the furniture frame F2. Specifically, a tail (hidden) section F1*a* of the upholstery fabric F1 is sandwiched between the fastening strip portion 10-1 of the protective strip 10 and an underlying portion of the furniture frame F2. Staples S are driven physically through both the fastening strip portion 10-1 and the sandwiched tail section F1*a* of the fabric F1 into the frame F2. In such a manner, the fabric tail section F1*a* is fastened physically to the furniture frame F2.

The remaining (visible portion) of the fabric F1 is tautly doubled over the fabric tail section F1*a*. The cover portion 10-2 of the protective strip 10 is thus folded over the heads of the staples S. Moreover, as discussed previously, the interior generally V-shaped space 10-4 (see FIG. 4) established when the protective strip 10 is in a closed condition as depicted in FIG. 3 will allow the fastener heads and misshapen fasteners to be accommodated without causing undesirable deformation of the cover strip portion 10-2. In such a manner, the heads of the staples S do not directly contact the fabric F1 but instead are physically covered by means of the cover portion 10-2. As such, localized regions of the fabric F1 are not subject to wear due to contact with the heads of the staples S.

Figure 6:
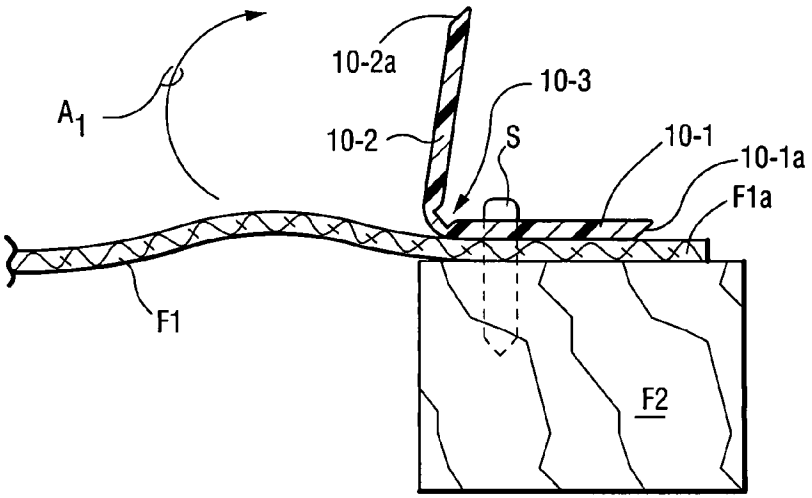
FIG. 6 is a cross-sectional elevational view as taken along line 6-6 in FIG. 5.
Figure 5:
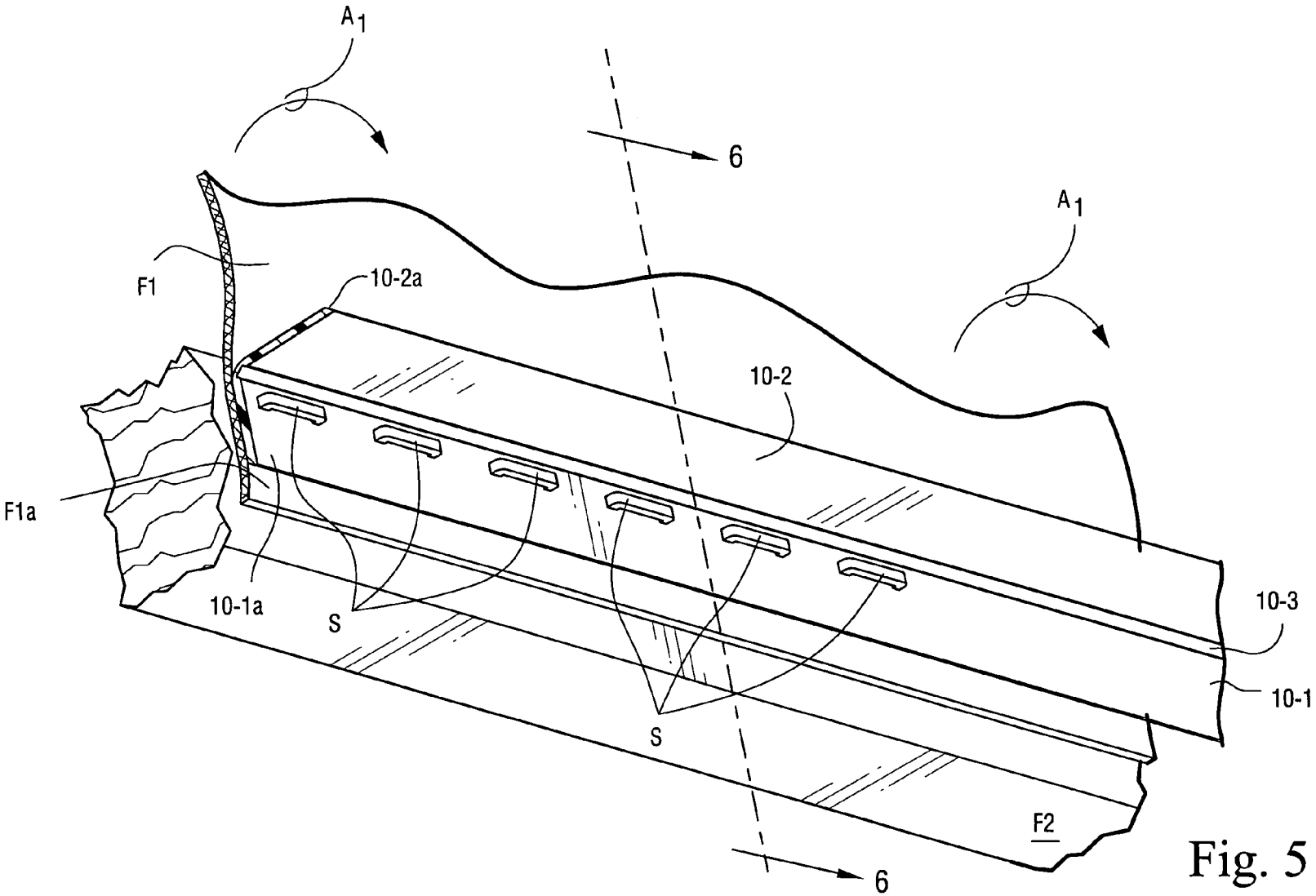
FIG. 5 is a perspective view of a manner in which upholstery fabric may be fastened to a furniture frame using a protective strip in accordance with the present invention.

In use, as depicted in accompanying FIGS. 5 and 6, the fabric tail section F1*a* is placed against a desired section of the furniture frame F2. A desired length of protective strip 10 is positioned in general alignment with the frame F2 so that the fastening strip portion 10-1 overlays the fabric tail F1*a*. Staples S may then be driven through the fastening strip portion 10-1 and the fabric tail section F1*a* so as to fasten each to the underlying section of furniture frame F2. Such a condition is depicted in FIG. 5. Thereafter, the remaining fabric F1 may be folded over the fabric tail F1 a (arrows A1 in FIGS. 5 and 6) so that its other end may be fastened in a similar manner to an opposed section of the furniture frame (not shown) and thereby tautly stretch the fabric F1 between its fastened ends. Folding the fabric F1 over the fabric tail F1*a* in turn causes the cover strip portion 10-2 to be folded over the fastening strip portion 10-1. As described previously, such flexible folding of the cover strip portion 10-2 over the fastening strip portion 10-1 is facilitated by the hinge portion 10-3. In such a manner, the heads of the staples S (or tacks not shown) are physically covered by the cover strip portion 10-2 so as to prevent contact with the overlaid fabric F1. As such, rubbing of the fabric against the staple heads (or tack heads) is prevented so as to preclude (or at least substantially minimize) fabric wear.

It will of course be appreciated that the protective strips 10 in accordance with the present invention may be used with any fasteners instead of, or in addition to, the staples S as depicted in the accompanying drawing FIGS. Thus, staples, tacks, nails, brads and like fastening means may be employed with equivalent desired results.

Figure 7:
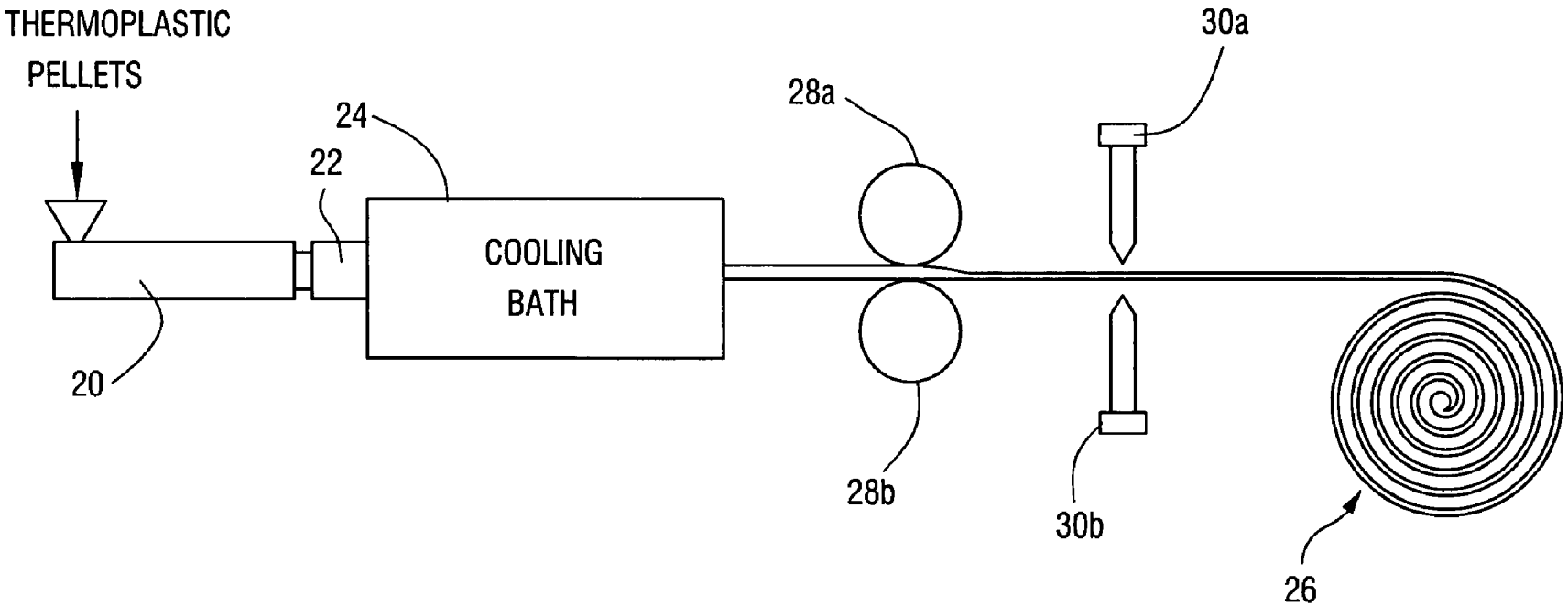
FIG. 7 is a schematic representation of one presently preferred fabrication technique for making the protective strips of the present invention.

Accompanying FIG. 7 depicts schematically one presently preferred fabrication technique for making the protective strips 10 of the present invention. In this regard, it is preferred that the protective strip 10 be produced in a continuous manner using conventional thermoplastic extrusion equipment well known to those skilled in the art. More specifically, thermoplastic pellets (e.g., polyethylene, polypropylene, or the like) may be introduced into a hopper of a conventional extruder 20 so as to form a melt which is extruded through a die 22 configured to form the protective strip in a profile shown in FIG. 2*b*. The extruded protective strip 10 may then be introduced immediately into a cooling water bath 24 so as to cool the same prior to winding into a roll 26. Suitable sizing and forming tools (not shown) may be positioned within the cooling water bath 24 so as to maintain the shape and configuration of the protective strip 10 as it is being cooled and solidified. Prior to being wound into a roll 26, however, it is preferred that the cooled protective strip 10 be flattened by means of opposed rollers 28*a*, 28*b* which serve to fold the cover strip portion 10-2 onto the fastening strip portion 10-1 and pull the protective cover strip 10 through the cooling water bath 24. Once a desired length of the protective strip 10 (e.g., several thousand feet) has been wound into the roll 26, it may be cut by means of opposed cutters 30*a*, 30*b* (e.g., conventional manually operated shears) so that a new roll may be formed.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A protective strip for fastening upholstery fabric to a furniture frame section comprising:

a fastening strip portion, a cover strip portion, and a hinge portion which flexibly joins adjacent respective edges of the fastening and cover strip portions, wherein the hinge portion is formed of a region of reduced material thickness so as to establish a recessed channel relative to the fastening and cover strip portions, and wherein the hinge portion includes a generally planar inner surface and a pair of oppositely disposed arcuately convex edge surfaces respectively joining the fastening and cover strip portions to the inner surface, the inner surface and the pair of arcuately convex edge surfaces extending along an entire length of the protective strip.

2. The protective strip as in claim 1, wherein the recessed channel causes a generally V-shaped interior space to be established in cross-section having a relatively wider region adjacent the hinge portion when the fastening and cover strip portions are folded over one another.

3. The protective strip as in claim 1, wherein each of the fastening and cover strip portions have a rounded terminal edge.

4. The protective strip as in claim 1, formed as a unitary, generally V-shaped structure.

5. The protective strip as in claim 4, wherein the generally V-shaped structure is comprised of a thermoplastics or paperboard material.

6. The protective strip as in claim 5, wherein the thermoplastics material is a polyolefin.

7. Upholstered furniture comprising a furniture frame, upholstery fabric, fasteners to fasten the upholstery fabric to the furniture frame, and a protective strip as in claim 1, wherein the fasteners fasten the fastening strip portion of the protective strip and a tail section of the upholstery fabric to the furniture frame, and wherein the cover strip portion of the protective strip is folded over the fastening strip portion so as to cover the fasteners.

8. A method of making upholstered furniture comprising the steps of:

(a) positioning an upholstery fabric tail section at one end of a piece of upholstery fabric over a furniture frame section;

(b) positioning a protective strip as in claim 1 over the upholstery fabric tail section;

(c) fastening the fastening strip portion of the protective strip and the upholstery fabric tail section to the furniture frame section by means of fasteners;

(d) folding a remaining portion of the upholstery fabric over the tail section so as to cause the cover strip section of the protective strip to be folded over the fasteners.

9. A method of making a protective strip for fastening upholstery fabric to a furniture frame section comprising the steps of:

(a) extruding a thermoplastic material through a die to form a protective strip as in claim 1;

(b) cooling the extruded protective strip of step (a); and (c) winding a length of the protective strip into a roll.

10. The method of claim 9, wherein between steps (b) and (c) the method further comprises (d) folding the cover strip portion onto the fastening strip portion so that the protective strip is wound as a substantially flat strip into a roll according to step (c).

11. The method of claim 9, further comprising cutting the protective strip to a desired length.

* * * * *